United States Patent [19]

Grenier

[11] 4,454,861

[45] Jun. 19, 1984

[54] FLUID FRICTION HEATER

[75] Inventor: Wilfred J. Grenier, Rutland, Mass.

[73] Assignee: Raymond E. Shea, Holden, Mass.

[21] Appl. No.: 245,569

[22] Filed: Mar. 20, 1981

Related U.S. Application Data

[63] Continuation of Ser. No. 34,828, Apr. 30, 1979, Pat. No. 4,277,020.

[51] Int. Cl.[3] ..... F22B 37/10

[52] U.S. Cl. ..... 126/247; 122/26; 237/1 R

[58] Field of Search ..... 237/1 R; 126/247; 122/26; 165/89

[56] References Cited

U.S. PATENT DOCUMENTS 4,143,639 3/1979 Frenette ..... 122/26

FOREIGN PATENT DOCUMENTS 371529 3/1923 Fed. Rep. of Germany ..... 122/26

*Primary Examiner*—Albert J. Makay
*Assistant Examiner*—Henry Bennett
*Attorney, Agent, or Firm*—John E. Toupal; Harold G. Jarcho

[57] ABSTRACT

A fluid friction heater is disclosed. The heater includes a housing having a cylindrical inner surface. At least nearly circumferential, closely spaced grooves are formed in the inner surface of the housing, the depth of the grooves being small relative to the diameter of the surface itself. A drum is mounted within the housing and has a cylindrical outer surface in close proximity to the inner surface of the housing. The outer surface of the drum has at least nearly circumferential, closely spaced grooves formed in it as well. The pitch of the grooves in the respective surfaces are different from one another. A liquid is injected into the space between the inner surface of the housing and the outer surface of the drum. The housing and the drum rotate relative to one another so that the liquid passing between their respective surfaces is sheared and agitated by the respective grooves in the surfaces.

6 Claims, 6 Drawing Figures

FLUID FRICTION HEATER

This is a continuation of application Ser. No. 034,828, filed Apr. 30, 1979, now U.S. Pat. No. 4,277,020.

BACKGROUND OF THE INVENTION

The present invention relates to liquid heating systems, and in particular to a liquid heating system in which the liquid is heated by internal friction and agitation.

In many applications it is desirable to translate mechanical or electrical energy into heat energy in a liquid. For example, electrical energy is often available for heating, but it is difficult to efficiently translate the electrical energy into heat energy without substantial energy losses in the conversion process. The electrical energy can be converted into mechanical energy using an electric motor, but the problem still remains of converting the mechanical energy into heat energy in an efficient fashion. These problems are accentuated by the fact that certain energy resources are rapidly being depleted, and the inefficient conversion of energy from one form to another can no longer be tolerated.

One type of device which has been developed to convert mechanical energy into heat energy passes a liquid through an agitation system in which the internal agitation and friction of the liquid causes it to be heated. Examples of such systems are found in the U.S. patents to Beldimano, U.S. Pat. No. 2,344,075; Wyszomirski, U.S. Pat. No. 3,198,191; Eskeli, U.S. Pat. No. 3,791,167 and Stenstrom, U.S. Pat. No. 4,004,553.

In the Beldimano and Wyszomirski patents panels emanating from a central hub dash the liquid against blades or cavities formed in the surrounding housing. The agitation of the liquid causes it to be heated. Eskeli and Stenstrom employ a thin disk which rotates so that a liquid flowing over the disk undergoes a shearing action at the edge of the disk, also causing the liquid to be heated.

In all of the devices discussed above, relatively large scale movement of the liquid is required, only a small portion of which results in agitation or shearing of the liquid which is effective to heat the liquid. The input energy required to cause the large scale movement of the water is essentially wasted. As the result, only a portion of the input energy is effectively translated into heat, substantially limiting the efficiency of such devices.

Applicant is aware of a device currently under development in which oil is passed through an annular space between a rotating drum and a stationary cylindrical housing. This system is described in an article contained in the Montachusett Review, Volume XV, No. 31, dated Mar. 14, 1979. This system has also been previously disclosed in other publications and media. However, the details of this system are not known to applicant, and as far as applicant knows, its feasibility has not been demonstrated.

SUMMARY OF THE INVENTION

The present invention provides a fluid friction heater which includes a housing having a cylindrical inner surface. At least nearly circumferential, closely spaced grooves are formed in the inner surface of the housing, the depth of the grooves being small relative to the diameter of the surface itself. A drum is mounted within the housing and has a cylindrical outer surface in close proximity to the inner surface of the housing. The outer surface of the drum has at least nearly circumferential, closely spaced grooves formed in it as well. The pitch of the grooves in the respective surfaces are different from one another.

A liquid is injected into the space between the inner surface of the housing and the outer surface of the drum. The housing and the drum rotate relative to one another so that the liquid passing between their respective surfaces is sheared and agitated by the respective grooves in the surfaces.

In the apparatus of the present invention, large scale movement of the liquid other than the passage of the liquid through the system does not occur. The crossing action of the grooves, which differ in pitch on the confronting surfaces, and the narrow clearance between the drum and the housing, induce an agitation and frictional shearing action in the liquid which is otherwise relatively stationary except for its traverse through the system. As a result, the transfer of energy from mechanical energy i.e., rotation of the drum, to heat energy in the liquid is quite efficient.

In one embodiment of the present invention, the grooves on the cylindrical surface of the housing are circular, and the grooves on the cylindrical surface of the drum have a spiral configuration. The drum rotates so that the spiral configuration of the drum grooves tends to advance the fluid through the system. In another embodiment of the present invention, the grooves and the cylindrical surface of the housing spiral in one direction, and the grooves in the cylindrical surface of the drum constitute a double spiral in the other direction. Again, this configuration tends to advance the liquid through the system. In these embodiments, impeller blades are located at one end of the drum, and the groove configuration cooperates with the impeller blades to drive the fluid through the system.

One aspect of the present invention is its incorporation into a two loop system in which one liquid operates in a closed loop and another liquid operates in an open loop. For example, the invention could be incorporated into a structure with the closed loop system used for heating and like purposes, and the open loop system used to generate hot water. In such a system, the heater as described above includes an outer jacket circumscribing the housing so that the second fluid can be heated by heat transfer through the housing. Both the open and closed loop systems can feed storage chambers so that the device can be operated at off-peak hours to minimize the cost of input energy.

In this application, the term "circumferential" or "circumferentially directed" is used to indicate grooves located in a plane perpendicular to the axis of a cylindrical configuration. This term is not used to indicate that the grooves need be continuous about an entire circumference. The term "pitch" is used to indicate the angle of inclination of grooves relative to a plane normal to the axis of a cylindrical configuration, but does not necessarily indicate that the grooves are continuous, as in a screw thread.

The novel features which are characteristic of the invention, as to organization and method of operation, together with further objects and advantages thereof will be better understood from the following description considered in connection with the accompanied drawings which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
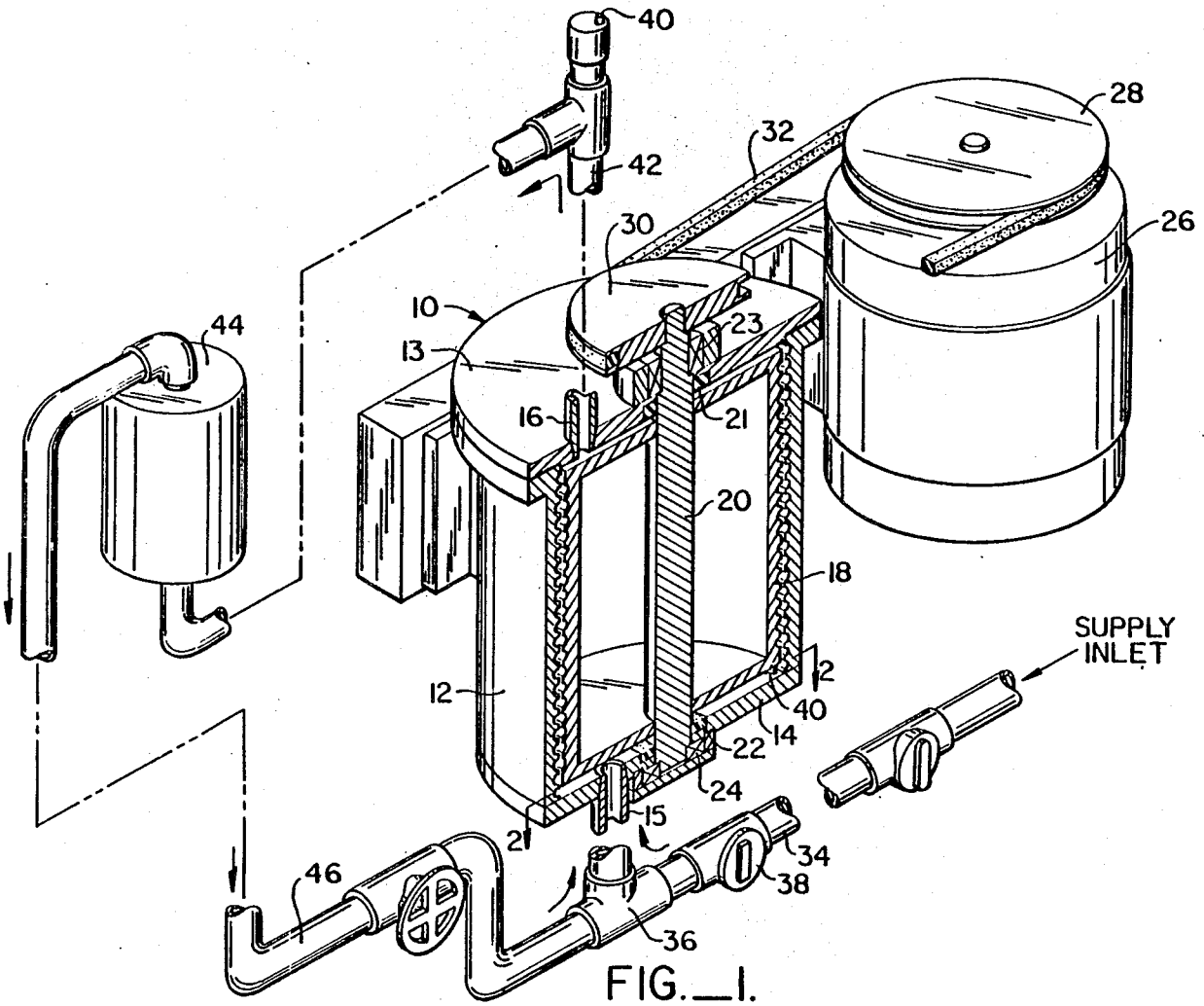
FIG. 1 is a fragmentary, partially cut-away perspective view of a system employing the fluid friction heater of the present invention.

A potential use of a fluid friction heater 10 constructed according to the teachings of the present invention is illustrated by way of reference to FIG. 1. Heater 10 includes a cylindrical housing 12 having end plates 13, 14 to form a closed chamber. A liquid inlet 15 is located in plate 14, and liquid outlet 16 is located in plate 13 so that a liquid can pass through housing 12 from one end to the other.

A generally cylindrical drum 18 is mounted within housing 12 on a shaft 20. Shaft 20 passes through bushings 21, 22 in end plates 13,14 of housing 12, and is supported by ball bearings 23, 24 outside the housing.

An electric motor 26 is located adjacent housing 12, and includes a driven output pulley 28. Output pulley 28 is connected to a corresponding pulley 30 on shaft 20 by drive belt 32. Electric motor 26 is thus used to rotate drum 18 within cylindrical housing 12, the housing itself being stationery.

Figure 2:
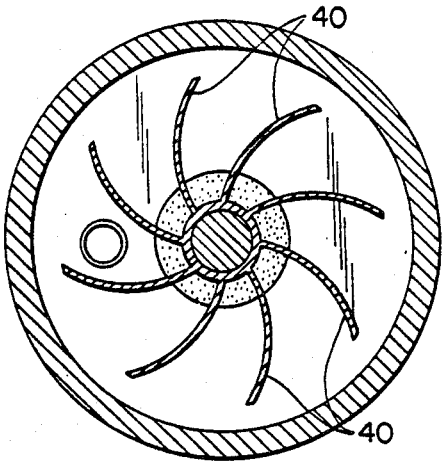
FIG. 2 is a section view taken along lines 2—2 of FIG. 1.

An inlet conduit 34 for a fluid such as water connects to inlet 15 in end plate 14 at T-fitting 36. A valve 38 is interposed at inlet conduit 34 to control the supply. The liquid enters housing 12 through inlet 15, and is forced radially outwardly by impeller blades 40 on drum 18, as illustrated in FIG. 2. Impeller blades 40 force the liquid to pass through the narrow annular space between the outer surface of drum 18 and the inner surface of housing 12. After the liquid passes through the annular space, it exits the housing at outlet 16.

As will be discussed in more detail hereinafter, the liquid is heated as it passes through the annular space between drum 18 and housing 12, and may even change from liquid to vapor.

A pressure relief valve 40 is interposed in the outlet conduit 42 from outlet 16. The heated liquid or vapor in outlet conduit 42 could be used directly. However, in the system illustrated in FIG. 1, the heated liquid or vapor passes to a storage chamber 44, from which it is withdrawn when needed. The heated liquid or vapor may either be consumed, or, as illustrated in the system of FIG. 1, recycled in a closed loop system through conduit 46.

Figure 3:
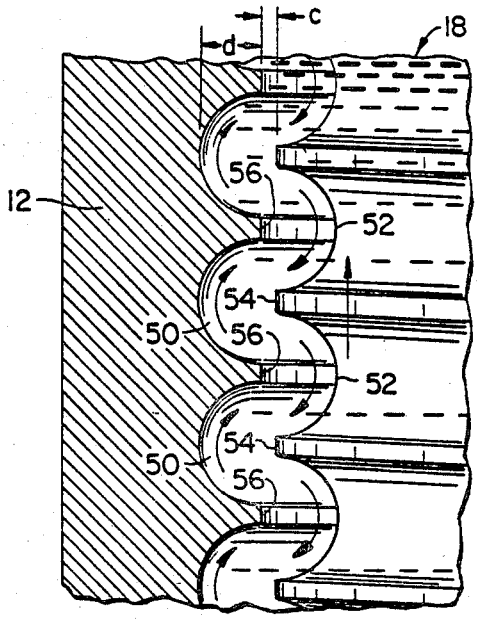
FIG. 3 is an expanded fragmentary sectional elevation view of a portion of the wall construction of the fluid friction heater of FIG. 1.
Figure 4:
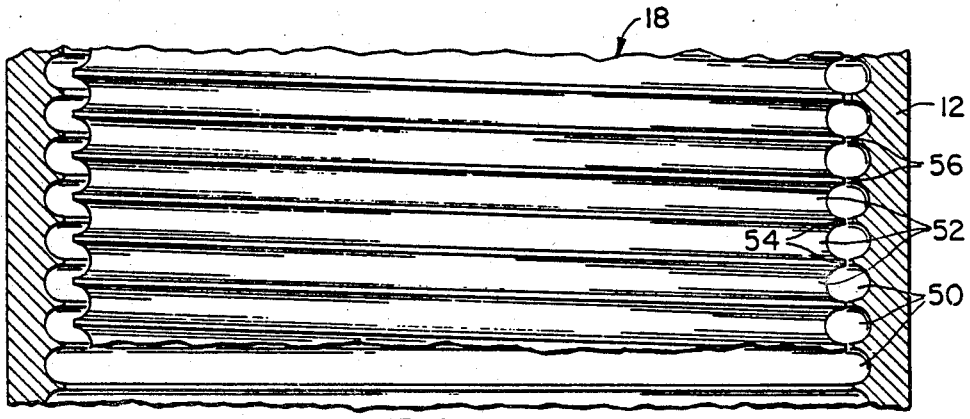
FIG. 4 is a fragmentary sectional elevation view of the wall construction of the fluid friction heater of FIG. 1.

The construction of the wall surfaces of housing 12 and drum 18 in heater 10 are illustrated in more detail by way of reference to FIG. 4. As is evident from the lower portion of FIG. 4, where drum 18 is broken away, the inner cylindrical surface of housing 12 contains a plurality of closely spaced, parallel, circumferential grooves 50. These grooves have a semicircular cross section. In an embodiment of the present invention in which the diameter of the inner cylindrical surface of housing 12 is approximately 6 inches, grooves having a depth of $\frac{1}{8}$ inch ("d" in FIG. 3) have been found to work quite well.

A plurality of nearly circumferential grooves 52 are formed in the outer cylindrical surface of drum 18. Nearly circumferential grooves 52 actually comprise a single spiral groove traversing the entire outer cylindrical surface of drum 18. The cross section of grooves 52 in drum 18 are the same as that of grooves 50, and in the embodiment discussed in the previous paragraph, the grooves also have a depth of approximately $\frac{1}{8}$ inch.

In the embodiment discussed above in which the diameter of the outer surface of drum 18 and inner surface of housing 12 is about 6 inches, the clearance between the outermost surface of the drum and the innermost surface of the housing ("c" in FIG. 3) is equal to about 1/16 inch. The ratio of the clearance between drum 18 and housing 12 in this embodiment is thus on the order of about 1/100 the diameter of the surfaces themselves.

The manner in which the surfaces of the drum 18 and the housing 12 heat the liquid flowing therebetween is illustrated by way of reference to FIG. 3. Since grooves 50 in the inner cylindrical surface of housing 12 are exactly circumferential and parallel, they have a pitch equal to zero. The pitch of spiral groove 52 in drum 18 is slightly greater than zero. Drum 18 is rotated in the direction so that the land 54 defining the groove continuously moves upwardly in FIG. 3, i.e., in the gross direction of movement of the liquid. The land 54 defining groove 52 thus crosses the lands 56 separating grooves 50 as the drum rotates. This action causes both a shearing action on the liquid as the lands cross one another, and an agitation as the liquid is forced back and forth between the grooves.

In heater 10, grooves 50 and 52 have a semicircular cross-section, and the edges of the grooves form a sharp, 90° corner at lands 56, 54 respectively. It is desirable that these corners remain sharp and uncontaminated by impurities in the liquid so that the agitation and shearing action is not degraded. If drum 18 and housing are constructed of aluminum, impregnating the surface with a low friction substance such as Teflon prevents such contamination. Such surface treatments are provided under the trademark Nituff by Poly-Metal Finishing Inc. of West Springfield, Mass. and Tufram by General Magniplate Corporation of Linden, N.J.

Because of the depth of the grooves 50, 52 is small relative to the diameter of the surfaces themselves, all of the agitation in the liquid takes place in a very confined region. In this region, the liquid is subjected to intense agitation and localized shearing forces. Such agitation and shearing forces cause the liquid to be heated, and the rotational energy of drum 18 is converted to heat energy in the liquid. There is very little gross motion of the water other than its passage to the system caused by impellers 40, as aided by the direction of rotation of drum 18, which is not converted to heat energy.

In the present invention, it is essential that the size of the grooves and the clearance between drum 18 and housing 12 be kept small. Small grooves and clearance result in localized internal shearing and agitation, which causes the liquid to be heated. Larger scale movement of the liquid, as would be caused by enlarging the grooves or increasing the clearance, does not heat the liquid, and constitutes a waste of input energy.

Figure 5:
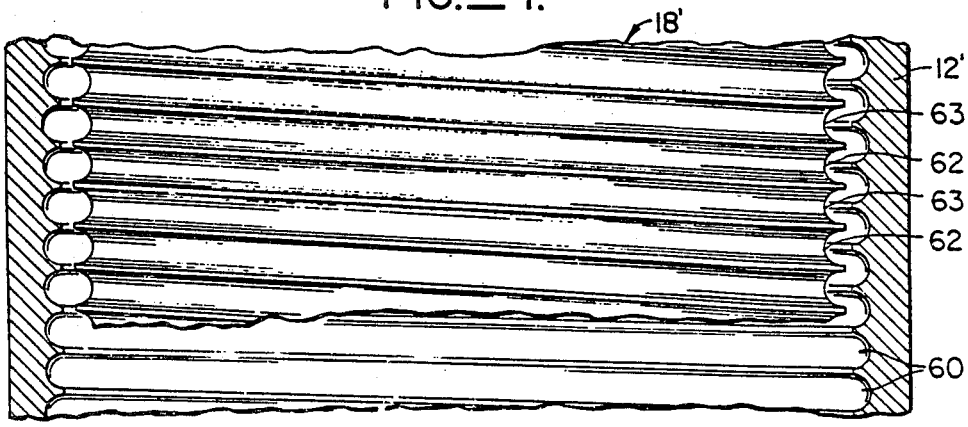
FIG. 5 is a fragmentary sectional elevation view similar to FIG. 4 of an alternate embodiment of the wall surface construction of the present invention.

An alternate embodiment of the groove configuration is illustrated in FIG. 5, in which the housing is designated 12' and the drum 18'. In this embodiment, a groove 60 is formed in the inner cylindrical surface of housing 12' which constitutes a single continuous spiral groove. In drum 18, a pair of interleaved spiral grooves 62, 63 are formed, each of the grooves having twice the pitch of groove 60 in the opposite direction. Drum 18' is rotated in the direction in which grooves 62, 63 cause the fluid to move in its gross direction of motion. Grooves 60 in housing 12' tend to resist such motion, but because the pitch of grooves 62, 63 is twice that of groove 60, the pitch of grooves 62, 63 will prevail and the overall tendency will be to force the fluid in its direction of motion.

Figure 6:
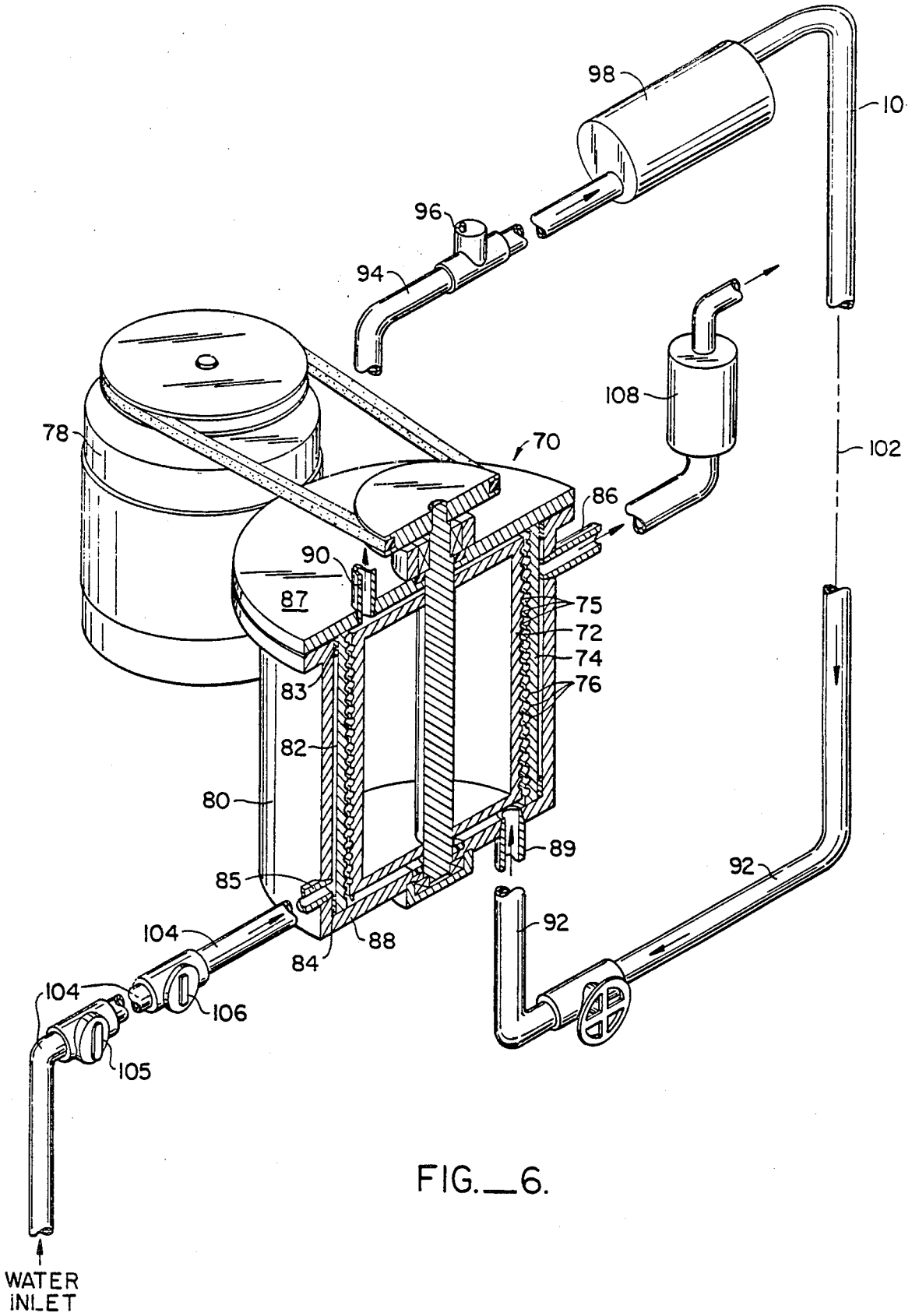
FIG. 6 is a fragmentary, partially cut-away perspective view of a home energy system employing an embodiment of the present invention.

A home heating system utilizing an embodiment 70 of the fluid friction heater of the present invention is illustrated by way of reference to FIG. 6. As in the previous embodiments, fluid friction heater 70 includes a rotatable drum 72 mounted within a housing 74. Grooves 75, 76 are formed in the confronting cylindrical surfaces of drum 72 and housing 74 respectively. The pitch of grooves 75 differs from grooves 76 so that the grooves cross one another when the drum is rotated by electric motor 78.

A jacket 80 circumscribes the outer cylindrical surface of housing 74, which is constructed from heat conductive material. A narrow cylindrical annular space 82 is formed between housing 74 and is enclosed by circumferential seals 83, 84 at either end. An inlet 85 is provided to circumferential space 82 through jacket 80, and a corresponding outlet 86 is provided on the other side of jacket 80. A liquid such as hot water enters inlet 85, flows around the outer circumference of housing 72 in annular space 82, and exits at 86.

End plates 87, 88 define an enclosed space circumscribing drum 72. An inlet 89 is provided in lower end plate 88, and an outlet 90 is provided in upper end plate 87. A fluid can thus be passed around the exterior of drum 72 from inlet 89 to outlet 90.

A fluid enters inlet 89 from conduit 92. This fluid passes around the exterior of drum 72 between the drum and housing 74 and is heated as described previously. This liquid exits through outlet 90 either as a liquid or vapor. The heated liquid or vapor passes through conduit 94 through pressure relief vent 96 to a storage chamber 98. The heated liquid or vapor is drawn from storage chamber 98 as desired to conduit 100, and is used for heating or for other home use in which a closed loop system is employed, as typified by dashed line 102. After the heated liquid and vapor is used, it returns through conduit 92 to inlet 89 and the cycle is repeated.

Water enters the system through conduit 104, and passes through a series of control valves 105, 106. The water enters inlet 85, and passes around the outer circumference of housing 74 in cylindrical space 82. The water in space 82 absorbs heat energy which is conducted through housing 74 so that such heat energy is not wasted. The heated water exits through outlet 86, and passes to a storage tank 108, where it is stored for subsequent use. The hot water is intended for consumption, and is not returned to the system.

It is evident from the above discussion that the fluid friction heater of the present invention can be used in various applications to generate heat energy in a liquid. The energy transfer from mechanical energy of rotation to heat energy is quite efficient because the energy of rotation is effectively employed to cause agitation and shearing of the liquid to heat the liquid in the present invention.

While preferred embodiments of the present invention have been illustrated in detail, it is apparent that modifications and adaptations of those embodiments will occur to those skilled in the art. For example, various continuous and discontinuous groove configurations could be employed within the context of the present invention. However, it is to be expressly understood that such modifications and adaptations are within the spirit and scope of the present invention, as set forth in the following claims.

What is claimed is:

1. A fluid friction heater comprising;

a housing having a cylindrical inner surface with at least nearly circumferentially directed, closely spaced grooves formed therein, the depth of said grooves being small relative to the diameter of the cylindrical inner surface;

a drum mounted within the housing and having a cylindrical outer surface in close proximity to the cylindrical inner surface of the housing, said outer surface having at last nearly circumferentially directed, closely spaced grooves formed therein, the depth of said grooves being small relative to the diameter of the cylindrical outer surface, the grooves in said inner surface and the grooves in said outer surface being arranged so as to produce longitudinal crossing therebetween in response to relative rotation between said housing and said drum;

means for injecting a liquid into the space between the cylindrical inner surface of the housing and the cylindrical outer surface of the drum; and means for causing relative rotation between the cylindrical inner surface of the housing and the cylindrical outer surface of the drum to subject the liquid to agitation and shearing action which heats the liquid.

2. A fluid friction heater as recited in claim 1 wherein the means for causing relative rotation comprises means for rotating the drum.

3. A fluid friction heater as recited in claim 2 wherein the injection means includes impeller blades mounted to one end of the drum.

4. A fluid friction heater as recited in claim 1 wherein the grooves in the cylindrical inner surface of the housing are substantially planar and parallel to one another, and wherein the grooves in the cylindrical outer surface of the drum comprise one or more grooves having a spiral configuration.

5. A fluid friction heater as recited in claim 1 wherein the grooves in the cylindrical inner surface of the housing comprise one or more grooves having a spiral configuration, and wherein the grooves in the cylindrical outer surface of the drum comprise one or more grooves having a spiral configuration in a direction opposite from the grooves of the housing.

6. A fluid friction heater as recited in claim 5 wherein the amount of pitch in the grooves in the cylindrical inner surface of the housing is different from the amount of pitch of the grooves in the cylindrical outer surface of the drum.

* * * * *